US007633365B2

(12) United States Patent
Harmon et al.

(10) Patent No.: US 7,633,365 B2
(45) Date of Patent: Dec. 15, 2009

(54) CIRCUIT BREAKER APPARATUS

(75) Inventors: Jason Edward Harmon, Bristol, CT (US); Chanchal Kumar Garg, Hyderabad (IN)

(73) Assignee: General Electric Company, Schenectady, NY (US)

( * ) Notice: Subject to any disclaimer, the term of this patent is extended or adjusted under 35 U.S.C. 154(b) by 118 days.

(21) Appl. No.: 11/770,056

(22) Filed: Jun. 28, 2007

(65) Prior Publication Data

US 2009/0002106 A1 Jan. 1, 2009

(51) Int. Cl.

| | |
|---|---|
| ***H01H 75/00*** | (2006.01) |
| ***H01H 77/00*** | (2006.01) |
| ***H01H 73/12*** | (2006.01) |
| ***H01H 9/02*** | (2006.01) |
| ***H01H 13/04*** | (2006.01) |
| ***H01H 9/44*** | (2006.01) |
| ***H01H 33/18*** | (2006.01) |
| ***H01H 33/08*** | (2006.01) |

(52) U.S. Cl. ..... 335/202; 335/8; 218/35; 218/157

(58) Field of Classification Search ..... 335/60, 335/202; 218/35, 157, 155, 156
See application file for complete search history.

(56) References Cited

U.S. PATENT DOCUMENTS

| | | | | |
|---|---|---|---|---|
| 4,644,308 | A * | 2/1987 | Guery et al. | 335/128 |
| 4,809,132 | A * | 2/1989 | Palmieri et al. | 361/634 |
| 5,093,544 | A * | 3/1992 | Lesslie et al. | 200/244 |
| 5,483,213 | A * | 1/1996 | Mueller et al. | 335/132 |
| 5,488,337 | A * | 1/1996 | Hubbard et al. | 335/202 |
| 5,652,698 | A * | 7/1997 | Eberts | 361/825 |
| 5,753,877 | A * | 5/1998 | Hartzel et al. | 218/157 |
| 5,772,479 | A * | 6/1998 | Fleege et al. | 439/801 |
| 6,037,555 | A * | 3/2000 | Castonguay et al. | 218/157 |
| 6,064,018 | A * | 5/2000 | Seymour et al. | 200/293 |
| 6,188,036 | B1 * | 2/2001 | Arnold | 218/157 |
| 6,236,294 | B1 * | 5/2001 | Zindler et al. | 335/172 |
| 6,280,264 | B1 * | 8/2001 | Whipple et al. | 439/814 |
| 6,373,357 | B1 * | 4/2002 | Douville et al. | 335/172 |
| 6,624,375 | B2 * | 9/2003 | Leone et al. | 218/155 |
| 6,919,785 | B2 * | 7/2005 | Douville et al. | 335/172 |
| 6,995,640 | B2 * | 2/2006 | Harmon et al. | 335/172 |
| 7,034,241 | B2 * | 4/2006 | Fleege et al. | 218/157 |
| 2004/0239458 | A1 * | 12/2004 | Harmon et al. | 335/174 |

* cited by examiner

*Primary Examiner*—Elvin G Enad
*Assistant Examiner*—Alexander Talpalatskiy
(74) *Attorney, Agent, or Firm*—Cantor Colburn LLP

(57) ABSTRACT

A circuit breaker assembly is disclosed. The assembly includes a base having an interior bottom surface that includes a first engagement feature and a circuit breaker cassette having an exterior bottom surface that includes a second engagement feature. The cassette is oriented in the base to provide for a current path through the base in a first direction. The first engagement feature engages with the second engagement feature and restrains movement of the cassette relative to the base in a second direction that is perpendicular to the first direction and parallel to the interior bottom surface.

16 Claims, 5 Drawing Sheets

CIRCUIT BREAKER APPARATUS

BACKGROUND OF THE INVENTION

The present disclosure relates generally to circuit breakers and particularly to cassette type molded case circuit breakers.

While conventional molded case circuit breakers may utilize a base that is a solid structural part of the breaker and acts to bear the loads of pressure and magnetic repulsion forces during a short circuit event, cassette-type circuit breakers can utilize a breaker base that is a protective shell rather than an actual structural part of the circuit breaker. Cassette breakers disposed within the base are designed to be the load-bearing members during a short circuit event, rather than the breaker base. In an example of a 3-phase circuit breaker, the cassettes are 3 individual poles and the pressure and magnetic forces on the breaker during a short circuit event create repulsive forces between the cassettes. If left unsupported, the cassettes would then spread apart and exert a significant undesirable stress on side walls of the base of the circuit breaker.

Methods to prevent such undesirable stress include increasing a thickness of side walls of the base, increasing venting, and reducing stress concentrations in the base. Additional solutions include use of hardware such as a rivet or screw, for example to secure the cassettes to each other, and thereby prevent them from spreading apart and applying force to the side walls of the base. Although these methods may be effective, increasing side wall thickness, within defined external envelope dimensions, results in a reduction of internal volume available for active circuit protection components, to which a rated current capacity is typically directly related. Further, use of hardware to secure cassettes together has the disadvantage of typically including a metal rod to span a width of all the cassettes within the breaker, thereby potentially creating a reduction in phase-to-phase dielectric isolation.

Accordingly, there is a need in the art for a circuit breaker arrangement that overcomes these drawbacks.

BRIEF DESCRIPTION OF THE INVENTION

An embodiment of the invention includes a circuit breaker assembly. The assembly includes a base having an interior bottom surface that includes a first engagement feature and a circuit breaker cassette having an exterior bottom surface that includes a second engagement feature. The cassette is oriented in the base to provide for a current path through the base in a first direction. The first engagement feature engages with the second engagement feature and restrains movement of the cassette relative to the base in a second direction that is perpendicular to the first direction and parallel to the interior bottom surface.

Another embodiment of the invention includes a circuit breaker assembly. The assembly includes a base having an interior bottom surface that includes a protrusion and a circuit breaker cassette having and exterior bottom surface that includes an engagement feature. The cassette is oriented in the base to provide for a current path through the base in a first direction. The protrusion engages with the engagement feature and restrains movement of the cassette relative to the base in a second direction that is perpendicular to the first direction and parallel to the interior bottom surface.

These and other advantages and features will be more readily understood from the following detailed description of preferred embodiments of the invention that is provided in connection with the accompanying drawings.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention provides an engagement feature molded into a base of a cassette-type molded case circuit breaker. In an embodiment, the engagement feature interfaces inside an exhaust vent of the cassette breaker and keeps the cassette breaker in place during a short circuit event, thereby reducing stresses imparted to the side walls of the base. Use of the engagement feature to restrain the cassette breaker eliminates use of additional parts, increases an overall available internal width between side walls of the base into which the cassettes are be disposed, and assists in maintaining a desirable dielectric isolation between poles of a multi pole circuit breaker.

Figure 1:
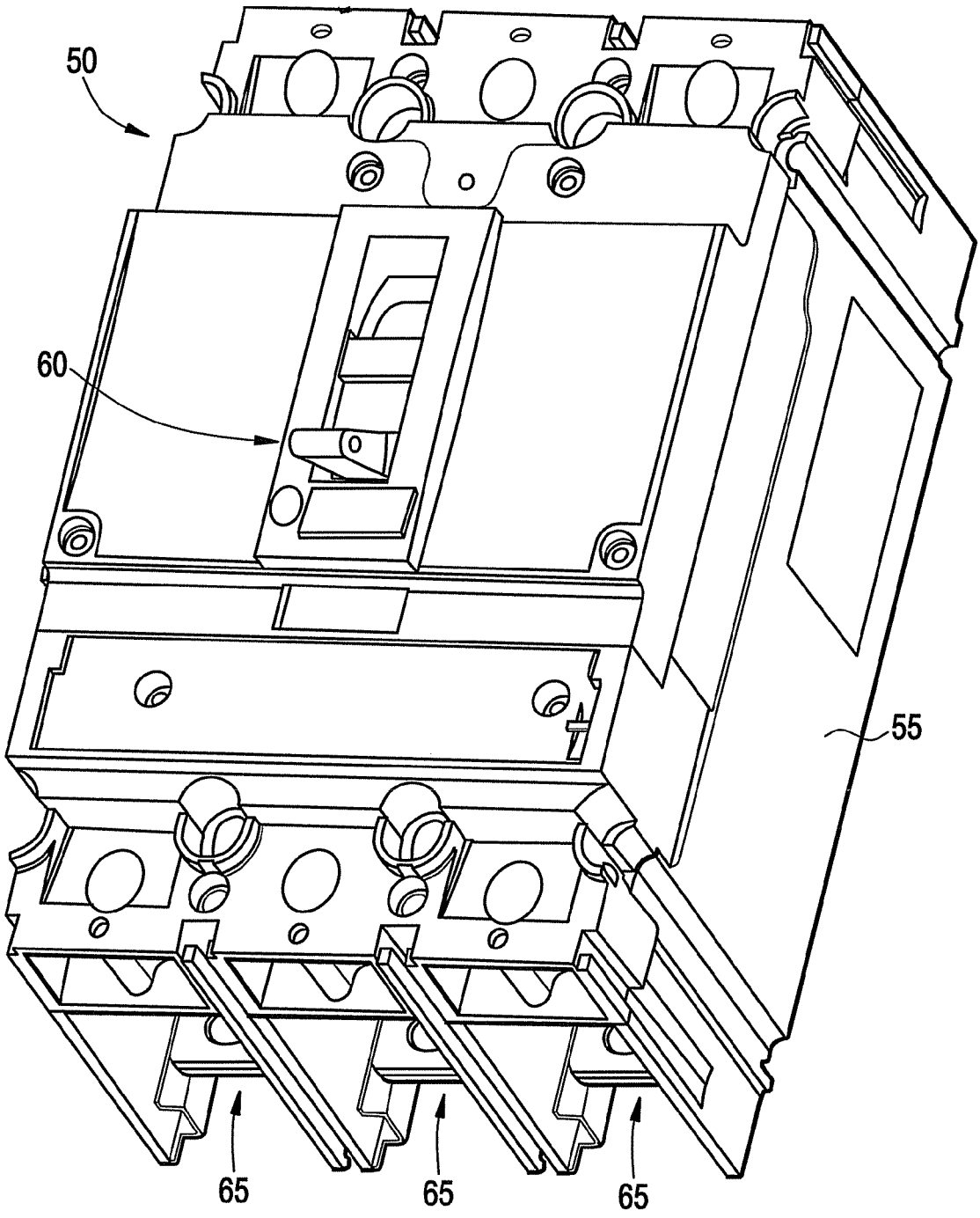
FIG. 1 depicts a top perspective view of a circuit breaker in accordance with an embodiment of the invention.

FIG. 1 depicts a top perspective view of an embodiment of a circuit breaker 50, such as a cassette-type molded case circuit breaker, for example. The circuit breaker 50 includes a base 55, an operating mechanism 60, and one or more cassette breakers 65 disposed within the base 55. In an exemplary embodiment, the circuit breaker 50 is a three-phase circuit breaker 50, and includes three cassette breakers 65.

Figure 2:
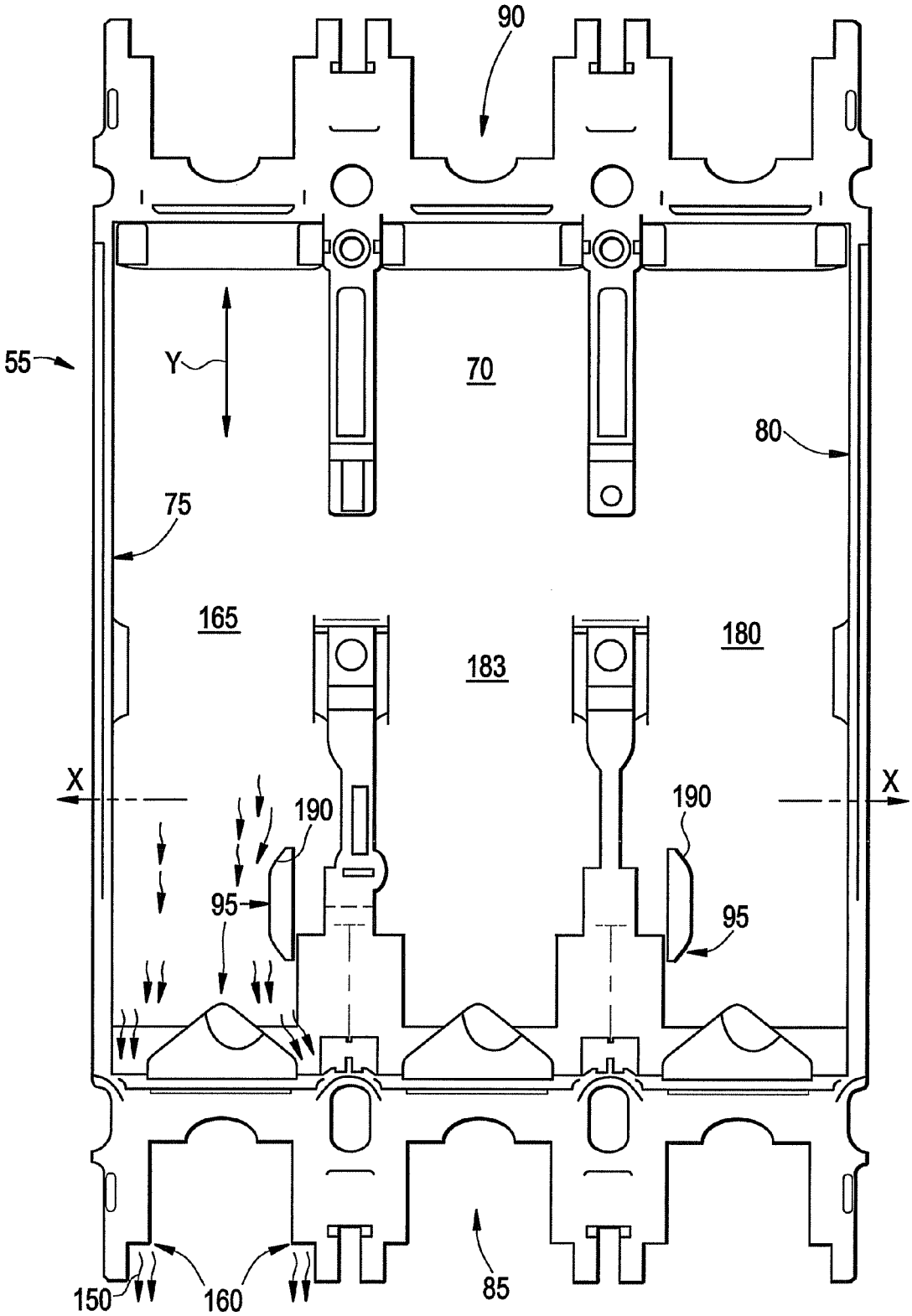
FIG. 2 depicts a top view of a base of the circuit breaker of FIG. 1 in accordance with an embodiment of the invention.

FIG. 2 depicts a top view of an embodiment of the base 55 into which the cassette breakers 65 are disposed. The base 55 includes an interior bottom surface 70, also herein referred to as a "bottom", two sides 75, 80, a front end 85, and a rear end 90. The bottom 70 of the base 55 includes engagement features 95, (also herein referred to as a "first engagement feature"), which will be described further below. In an embodiment, the base 55 is a molded base 55. In an exemplary embodiment, the base is a molded base 55 made from thermoplastic material. Use of thermoplastic material allows an increased flexibility with respect to geometry and features that may be molded within the base 55. Alternatively, and while not having the advantages of being molded from a thermoplastic material, the base 55 may be molded from a thermoset material.

Figure 3:
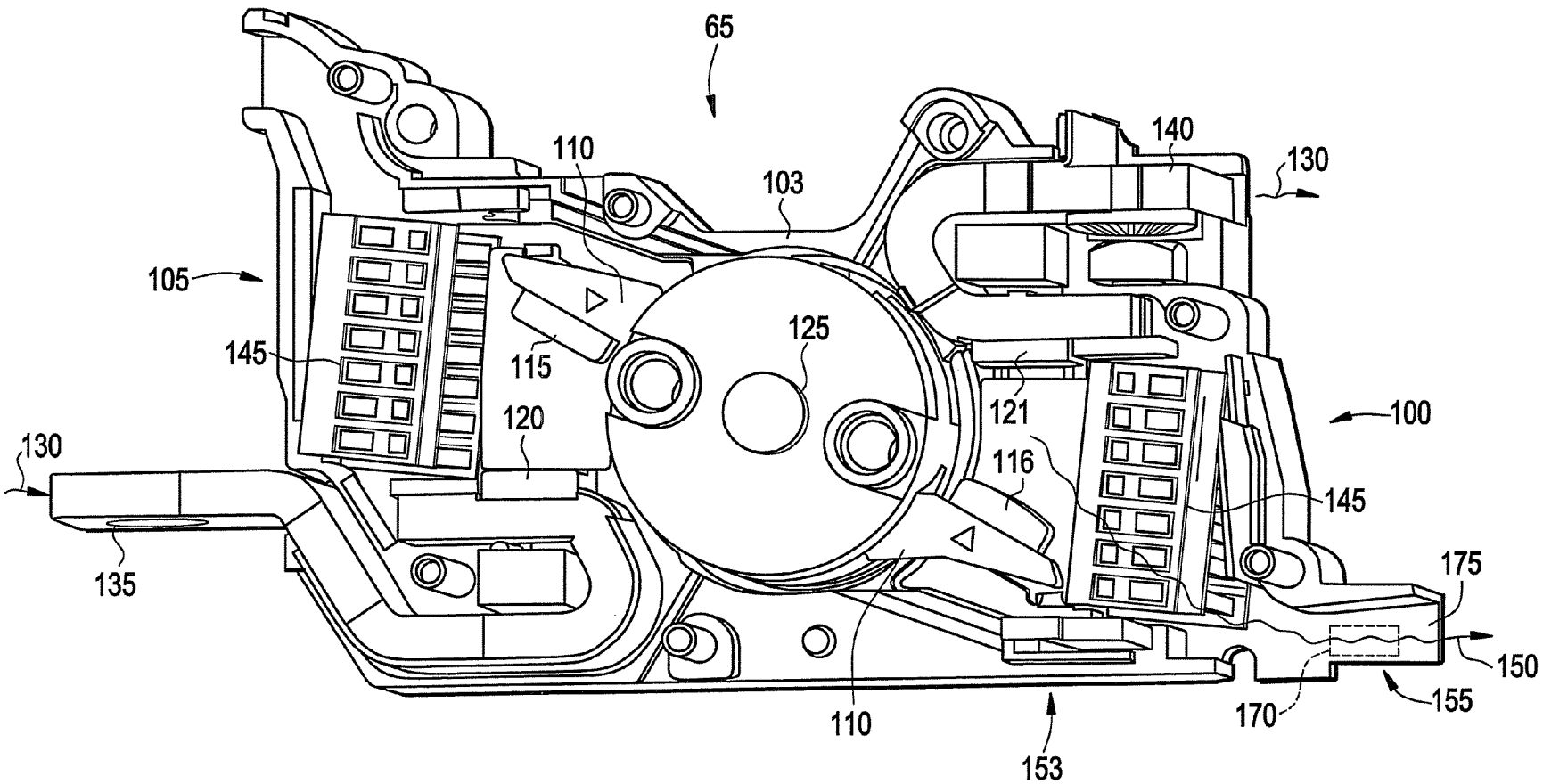
FIG. 3 depicts a side cutaway view of a cassette breaker in accordance with an embodiment of the invention.

FIG. 3 depicts a side cutaway view of an embodiment of the cassette breaker 65. Referring to FIG. 3 in conjunction with FIG. 2, the cassette breaker 65 has a front end 100 and a rear end 105, and is disposed within the base 55 such that the front end 100 of the cassette breaker 65 is proximate the front end 85 of the base, and the rear end 105 of the cassette breaker 65 is proximate the rear end 90 of the base 55. A cassette 103 or housing of the cassette breaker 65 provides a casing into which components of the cassette breaker 65 are disposed.

The cassette breaker 65 includes a moveable contact arm 110 upon which moveable contacts 115, 116 are disposed. The contact arm 110 is depicted in FIG. 3 in an OPEN position, such that the moveable contacts 115, 116 are separated from fixed contacts 120, 121. It will be appreciated that in response to the contact arm 110 being disposed in a CLOSED position, such as to rotate counter clockwise about pivot 125, the moveable contacts 115, 116 will be in physical and electrical connection with the fixed contacts 120, 121, thereby defining a current path 130 including the contact arm 110. In response to the contact arm 110 being disposed in the CLOSED position, the current path 130 includes a line strap 130, the fixed contact 120, moveable contact 115, the contact arm 110, moveable contact 116, fixed contact 121, and a load strap 140. The cassette breaker 65 is oriented within the base 55 such that the current path 130 is oriented relative to the base 55 in a first direction, best seen as direction line Y in FIG. 2.

As will be appreciated by one of skill in the art, the contact arm 110 may be moved between OPEN and CLOSED positions by the operating mechanism 60. Further, the contact arm will be moved from the CLOSED position to the OPEN position in response to a trip event, such as a short circuit, or a current that exceeds a defined level for a defined time, for example. In response to a trip event, such as the short circuit, an arc may be generated between the fixed contacts 120, 121 and the moveable contacts 115, 116 as the moveable contacts 115, 116 are separated from the fixed contacts 120, 121. Arc extinguishing devices (also referred to as arc chutes) 145 extinguish arcs that may be created during the trip event. Furthermore, associated with generation of the arc is a production of heat that causes an expansion of gases surrounding the arc proximate the contacts 115, 116, 120, 121. A flow path 150 of the hot, expanding gases is depicted and begins proximate the contacts 116, 121, continues through the arc chute 145, and exits the cassette breaker 65 via an opening 155 in the cassette 103 disposed at a bottom surface 153 and front end 100 of the cassette 103 known as an exhaust vent 155.

Figure 4:
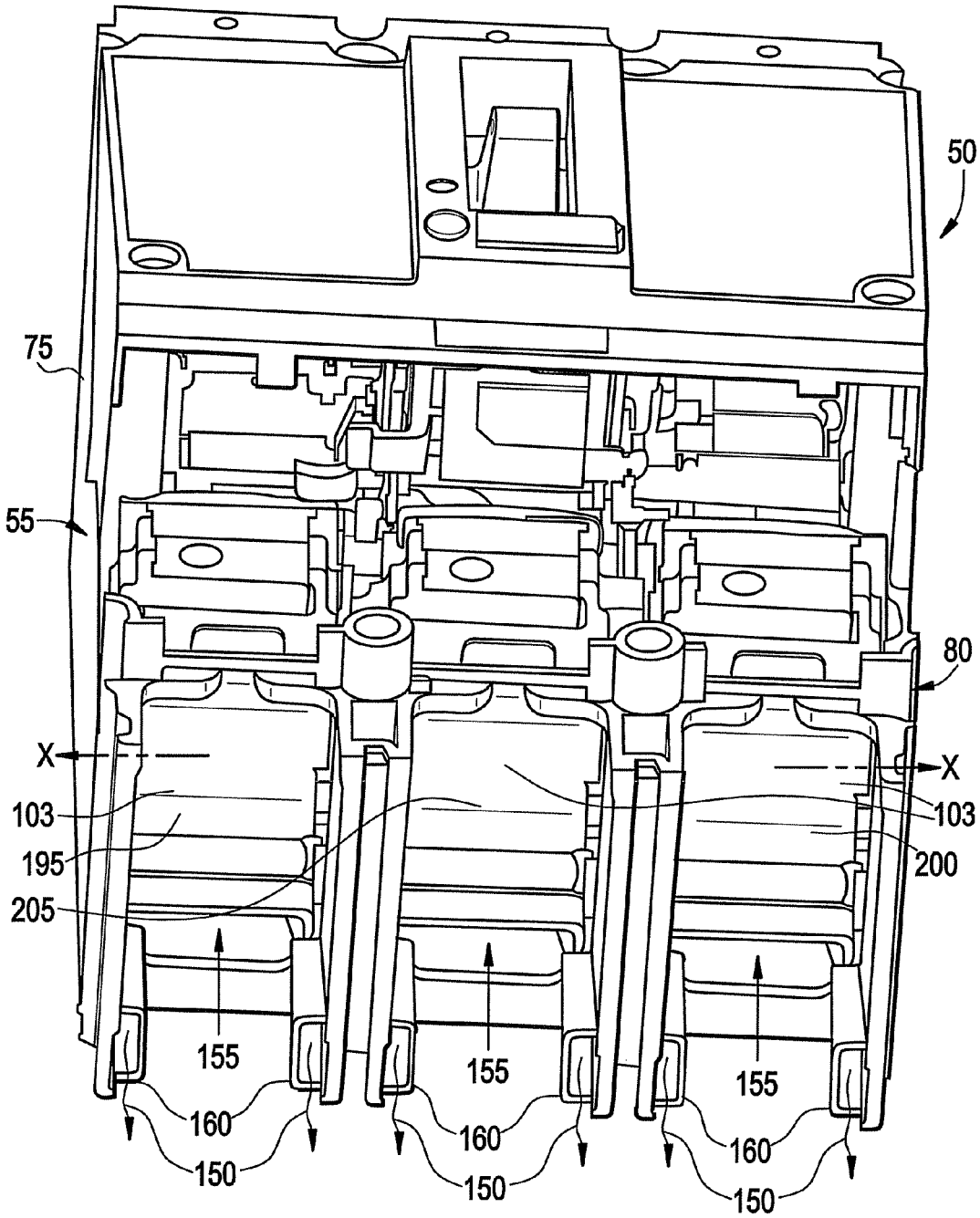
FIG. 4 depicts a top perspective cutaway view of the circuit breaker in FIG. 1 in accordance with an embodiment of the invention.

FIG. 4 depicts a top perspective cutaway view of an embodiment of the circuit breaker 50. The front 85 of the base 55 has been removed for clarity of illustration of three cassette breakers 65 oriented side by side within the base 55 of the circuit breaker 50. Molded within a portion of the base 55, disposed near the bottom 70 at the front end 85 of the base 55 are exhaust ports 160. Following disposal of the cassette breaker 65 within the base 55, the exhaust ports 160 are aligned with the exhaust vent 155 of the cassette 103. Obstructions (not shown) within the base 55 disposed proximate the exhaust vents 155 of the cassette breakers 65 cause the flow path 150 of the hot, expanding gases to be diverted such that the gases exit the breaker 50 via the exhaust ports 160.

In response to a short circuit trip event of a multi-pole circuit breaker 50, such as a three-phase circuit breaker for example, magnetic repulsion forces are created by high currents running parallel in each current path 130 of each cassette breaker 65 or pole of the circuit breaker 50. These magnetic repulsion forces are directed as shown by direction arrows X, perpendicular to the direction Y of the current path 130, and act upon the two outer cassettes 65, so as to tend to cause the two outer cassettes 65 to be displaced toward the sides 75, 80 of the base 55.

Referring now to FIG. 2 in conjunction with FIG. 3, it will be appreciated that disposing the cassette breaker 65 into a left portion 165 of the base 55 such that the front end 100 of the cassette breaker 65 is disposed proximate the front end 85 of the base 55, will result in the engagement feature 95 contacting an engagement area 170 (also herein referred to as a "second engagement feature") of an interior surface 175 of the exhaust vent 155. It will be further appreciated that a similar engagement area is present disposed upon an interior surface of the opposite internal section of the cassette 103, such that disposing the cassette breaker 65 into a right portion 180 of the base 55 will result in the engagement feature 95 in the right portion 180 of the base 55 contacting the similar engagement area. Accordingly, disposal of cassette breakers 65 into the left portion 165, right portion 180, and a center portion 183 of the base 55 thereby defines a left pole cassette 195, a right pole cassette 200 and a center pole cassette 205 (best seen with reference to FIG. 4).

In an embodiment, the engagement feature 95 is a protrusion that extends upward (out of the plane of the page of FIG. 2) from the interior bottom 70 of the base 55 to contact the engagement area 170. The engagement feature 95 engages with the engagement surface 170 and restrains sideways movement of the cassette 103 of the cassette breaker 65 in the direction X, perpendicular to the direction Y of the current path 130 and parallel to the bottom 70. Engagement of the feature 95 and surface 170 thereby transfers magnetic repulsion forces (in direction X) acting upon cassette breakers 65 from the cassettes 103 via the area 170 to the engagement feature 95 and into the bottom 70 of the base 55. Accordingly, such transfer of the magnetic repulsion forces thereby restricts motion of the cassette 103, and reduces a likelihood of damage to the sides 75, 80 of the base 55. In the embodiment of the three phase circuit breaker 50, the engagement features 95 are disposed corresponding to the left pole cassette 195 and the right pole cassette 200, at outer sides of the three cassette breakers 65 oriented side by side and disposed in the left portion 165 and right portion 180 proximate the two sides 75, 80 of the base 55.

The flow path 150 of hot exhaust gases depicted by wavy lines includes the obstructions described above, which divert the flow path 150 and cause the gases to exit via the exhaust ports 160 molded into the base 55. The engagement feature 95 represents an additional obstruction in the flow path 150, and can be recognized as depicted in FIG. 2 to result in a diversion of the flow path 150 in the direction X. It is contemplated that excessive obstruction of the flow path 150 will reduce a flow rate of the hot gases and thereby increase a peak gas pressure within the cassette 65 in response to the arc generation. It is further contemplated that an increase in peak gas pressure may result in an increase in force directed as indicated by X.

Figure 2A:
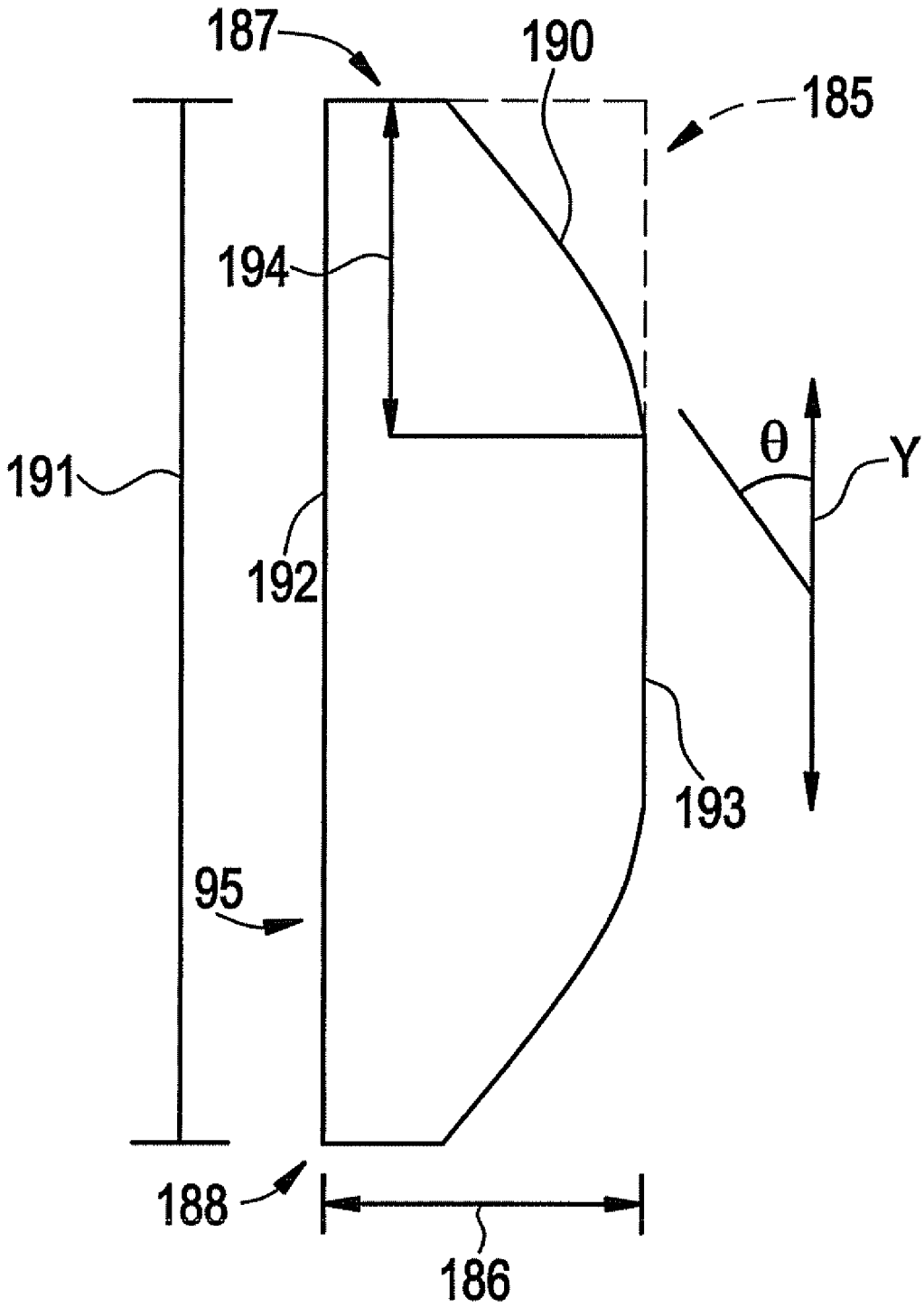
FIG. 2A depicts an enlarged view of an engagement feature of the base of FIG. 2 in accordance with an embodiment of the invention.

FIG. 2A depicts an enlarged view of geometry of the engagement feature 95 disposed within the right portion 180 of the base 55. It will be appreciated that the engagement feature 95 disposed within the left portion 165 includes similar geometry. The engagement feature 95 includes geometry to reduce an amount of obstruction to the flow path 150. For example, an abrupt obstruction 185 oriented perpendicular to the direction Y, or flow path 150, is anticipated to result in an increased peak gas pressure, as it is a direct barrier impeding the flow path 150. Geometry of the engagement feature 95, (depicted in solid lines) presents a gradual obstruction to help divert the flow path 150 around the engagement feature 95 with a reduced increase in peak gas pressure as compared to the abrupt obstruction 185. In an embodiment, a length 191 of the engagement feature 95 is aligned with the direction Y and the gradual obstruction includes a width 186 (aligned with Direction X) of the engagement feature 95 that increases from a first side 192 of the engagement feature toward a second side 193 of the engagement feature 95. In an embodiment, the width 186 of the engagement feature 95 is a function of position relative to the length 191 of the engagement feature 95 such that the width 186 increases from a rear end 187 of the length 191 of the engagement feature 95 toward a front end 188 of the length 191 of the engagement feature 95. In an embodiment, the width 186 of the engagement is related to a portion 194 that is less than 100% of the length 191 of the engagement feature 95. In one embodiment, an angle θ included between the direction Y and a surface 190 or sloping face of a side 192 of the engagement feature 95 disposed proximate the rear end 187 is less than ninety degrees. In another embodiment, the geometry of the engagement feature 95 includes a trapezoidal shape.

It will be appreciated that, as described herein, use of the mating engagements 95, 170 reduces a likelihood of damage to sides 75, 80 of the base 55 following a short circuit trip event. Furthermore, the mating engagements 95, 170 reduce the likelihood of damage while maintaining a given thickness of the sides 75, 80 within defined external dimensions of the circuit breaker 50, thereby maintaining internal dimensions of the base 55 for circuit protection components. Accordingly, a current rating for the circuit breaker 50, within the defined external dimensions may be increased. For example, use of the mating engagements 95, 170 are contemplated, within a breaker having standardized external dimensions known as an "E-Frame", to provide sufficient internal volume for cassette breakers 65 capable of achieving a 200 kiloAmp High Interruption Current rating at 480 volts of alternating current, a rating which has heretofore been unavailable in the "E-Frame" size circuit breaker. Additionally, use of the engagements 95, 170 can result in a reduced number of openings between the cassette breakers 65 for mechanical hardware to secure the cassettes 103 together, and therefore provides an increase in dielectric isolation between the cassette breakers 65.

While an embodiment of the invention has been described employing a 3 pole circuit breaker, it will be appreciated that the scope of the invention is not so limited, and that the invention also applies to a circuit breakers having other numbers of poles, such as 1, 2, 4, or more poles, for example. Further, while an embodiment of the invention has been described having a protrusion on the base 55 projecting into the exhaust vent 155 of the cassette 103, it will be appreciated that the scope of the invention is not so limited, and that the invention also applies to circuit breakers 55 having other cassette 103 restraint arrangements, such as a protrusion extending from the cassette 103 into a recess within the bottom 70 of the base 55, for example. While an embodiment of the invention has been depicted having a engagement feature 95 with trapezoidal geometry, it will be appreciated that the scope of the invention is not so limited, and that the invention also applies to embodiments having other geometry to divert the flow path 150, such as triangular, round, and elliptical, for example.

As disclosed, some embodiments of the invention may include some of the following advantages: reduced base damage following short circuit trip events; enhanced dielectric separation between cassettes via elimination of hardware spanning a width of the cassette breaker; and an increased current rating within a given external dimensional envelope.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A circuit breaker assembly comprising:

a base having an interior bottom surface comprising a first engagement feature; and a circuit breaker cassette having a bottom surface with a perimeter, the cassette also having an exterior bottom surface comprising a second engagement feature, the cassette being oriented in the base to provide for a current path through the base in a first direction;

wherein the first engagement feature engages with the second engagement feature and restrains movement of the cassette relative to the base in a second direction that is perpendicular to the first direction and parallel to the interior bottom surface, the first engagement feature being disposed to lie within the perimeter of the bottom surface of the cassette;

wherein the circuit breaker assembly is a three phase circuit breaker assembly comprising three circuit breaker cassettes oriented side by side within the base to define left pole, center pole, and right pole cassettes, and the interior bottom surface of the base comprises two first engagement features disposed corresponding to the left pole and right pole cassettes.

2. The assembly of claim 1, wherein the bottom surface of the cassette comprises an exhaust vent.

3. The assembly of claim 2, wherein:

the first engagement feature comprises a protrusion extending from the interior bottom surface of the base; and the second engagement feature comprises an interior surface of the exhaust vent.

4. The assembly of claim 3, wherein a length of the protrusion is aligned with the first direction and increases from a first side of the protrusion toward a second side of the protrusion.

5. The assembly of claim 4, wherein a side of the protrusion comprises a surface oriented at an angle less than 90 degrees relative to the first direction.

6. The assembly of claim 4, wherein the width of the protrusion is a function of position along the length such that the width increases from a first end of the protrusion toward a second end of the protrusion.

7. The assembly of claim 6, wherein the width of the protrusion is a linear function of position along a portion of the protrusion less than 100% of the length of the protrusion.

8. The assembly of claim 3, wherein the protrusion has a trapezoidal shape.

9. The assembly of claim 1, wherein the base is a molded base.

10. The assembly of claim 9, wherein the molded base comprises thermoplastic material.

11. A circuit breaker assembly comprising:

a base having an interior bottom surface comprising a protrusion extending from the interior bottom surface; and a circuit breaker cassette having a bottom surface with a perimeter, the cassette also having an exterior bottom surface comprising an engagement feature, the cassette being oriented in the base to provide for a current path through the base in a first direction;

wherein the protrusion engages with the engagement feature and restrains movement of the cassette relative to the base in a second direction that is perpendicular to the first direction and parallel to the interior bottom surface, the engagement feature being disposed to lie within the perimeter of the bottom surface of the cassette;

wherein the circuit breaker assembly is a three phase circuit breaker assembly comprising three circuit breaker cassettes oriented side by side within the base to define left pole, center pole, and right pole cassettes, and the interior bottom surface of the base comprises two first engagement features disposed corresponding to the left pole and right pole cassettes.

12. The assembly of claim 11, wherein:

the bottom surface of the cassette comprises an exhaust vent; and the engagement feature comprises an interior surface of the exhaust vent.

13. The assembly of claim 11, wherein a length of the protrusion is aligned with the first direction and increases from a first side of the protrusion toward a second side of the protrusion.

14. The assembly of claim 13, wherein a side of the protrusion comprises a surface oriented at an angle less than 90 degrees relative to the first direction.

15. The assembly of claim 11, wherein the protrusion has a trapezoidal shape.

16. The assembly of claim 11, wherein the base is a molded base.

* * * * *